United States Patent [19]

Johnson

[11] 3,956,871

[45] *May 18, 1976

[54] CONTAINER BRANDING APPARATUS

[75] Inventor: John A. Johnson, New Richmond, Ohio

[73] Assignee: Cedar Sales Company, Cincinnati, Ohio

[ * ] Notice: The portion of the term of this patent subsequent to Mar. 25, 1992, has been disclaimed.

[22] Filed: Nov. 21, 1974

[21] Appl. No.: 525,978

Related U.S. Application Data

[63] Continuation-in-part of Ser. No. 405,909, Oct. 12, 1973, Pat. No. 3,872,646.

[52] U.S. Cl. ..... 53/67; 53/131; 53/373

[51] Int. Cl.[2] ..... B65B 61/02; B65B 57/08

[58] Field of Search ..... 53/67, 131, 375, 373; 93/44.1 GT, 36 R; 101/11, 31

[56] References Cited

UNITED STATES PATENTS

| | | | |
|---|---|---|---|
| 2,320,361 | 6/1943 | Hothersall | 101/11 |
| 2,369,172 | 2/1945 | Nordquist | 101/11 |
| 2,558,354 | 6/1951 | Gottscho | 101/31 X |
| 2,597,634 | 5/1952 | Grevich | 53/131 |
| 2,669,815 | 2/1954 | Zinn | 53/375 X |
| 3,121,984 | 2/1964 | Ronco | 53/67 |
| 3,405,505 | 10/1968 | Mistarz | 93/44.1 GT |
| 3,545,169 | 12/1970 | Nash | 53/67 |
| 3,558,403 | 1/1971 | Richie | 53/375 X |
| 3,619,979 | 11/1971 | Martensson | 53/375 X |
| 3,752,067 | 8/1973 | Gill | 101/37 |
| 3,872,646 | 3/1975 | Johnson | 53/131 |

*Primary Examiner*—Travis S. McGehee
*Assistant Examiner*—John Sipos
*Attorney, Agent, or Firm*—Wood, Herron & Evans

[57] ABSTRACT

Brander apparatus, for container filling and sealing machines, is actuated by independent driving means controlled by movement or operation of carton treating apparatus at a station in the filling and sealing machine spaced from the brander station. An anvil and a dater block, having protruding date indicia, are mounted so that one is movable toward the other for branding, via actuation of an associated air cylinder and reciprocating cylinder shaft. In several embodiments, pressurized air is transmitted to the cylinder by a valve which is positioned to be actuated by movement of the carbon treating apparatus. In another embodiment, the brander actuating cylinder is commonly actuated with actuation of another cylinder for upstream carton treatment. Additional control apparatus is provided for eliminating the double branding of containers.

62 Claims, 11 Drawing Figures

CONTAINER BRANDING APPARATUS

This application is a continuation-in-part of U.S. Pat. application Ser. No. 405,909, filed Oct. 12, 1973 and entitled "Carton Dating Apparatus" now U.S. Pat. No. 3,872,646. This application is related to U.S. application Ser. No. 422,886, filed Dec. 7, 1973 and entitled "Carton Branding Apparatus."

This invention relates to container marking apparatus and more particularly to apparatus for applying dated indicia, by branding, to liquid containers or cartons for containing perishable goods such as milk.

In the milk packaging industry, it is becoming increasingly mandatory in many localities to applies visible date indicia to milk containers in order to indicate the date on which the milk was packaged and thereby aid the consumer in choosing fresh milk and the retailer in eliminating old and perhaps soured milk from his shelves. Since milk is normally packaged by a large number of independent diaries, it is common for each diary to apply the packaging date to the milk cartons at the time the milk is packaged by the diary.

With respect to the currently typical polythylene coated paperboard milk cartons, the actual carton dating has been accomplished in primarily three different modes: inking, stamping or embossing, and branding. Typically, the dates are applied to the upstanding top rib of the well-known carton gabletop structure now in extensive use. Where the inking technique, whether wet or dry, is used, the dater must always be provided with a supply of ink fluid, inked tapes or the like and thus required fairly frequent attention during operation. The stamping or embossing technique requires no such consumable supply but the stamped or embossed date is not highly visible and does not meet the visibility regulations of some areas. Unlike these, the branding mode requires no ink or ink tape supply. Further, the brand produced is highly visible as contrasted with the embossing techinque due to the partial burning of the polythylene and of the paperboard. The branding mode would thus seem to be at least technically preferred and is the preferred dating mode contemplated by the present invention, although the invention could be adapted for use within the other modes as well.

There are currently a number of different types of carton filling and sealing apparatus commercially available for packaging milk in such cartons; some include a dating capability and others, as originally manufactured, do not. When a particular locality adopts a milk carton dating regulation, affected dairies having filling and sealing apparatus with no dating capability face the problem of purchasing daters to conform to the regulations. In addition, it is desirable, from a practical marketing standpoint, for the manufacturer of new filling and sealing apparatus to provide a dating capability to such apparatus as will be sold in areas having dating regulations. In both instances, it is highly desirable to keep initial cost down and to eliminate or reduce other cost factors such as maintenance.

I have previously disclosed, in my aforementioned U.S. Pat. applications Ser. Nos. 405,909 and 422,886, dating or branding apparatus which is particularly useful with certain filling and sealing machines. In each of those applications, such apparatus disclosed is particularly unique in that it requires no independent driving mechanism of its own but rather derives its operative movements from the motion of other normally moving elements, at spaced stations, of the filling and sealing apparatus. The apparatus disclosed therein can be incorporated in the filler and sealer as original equipment or can be added later after the filler and sealer has been installed.

While the apparatus of each of the above patent applications has proved successful in connection with certain filling and sealing machines, and has a broad range of applications, other filling and sealing machines are made by a plurality of companies and in a number of models. Each may vary in its structure and operation and I have now provided additional dating appatatus particularly adapted to a number of these.

As an example, I have provided date indicia branders for carton filling and sealing machines made by the Ex-Cell-O Corporation and known in the trade by the model designations: TP, XP, VP, ZP, HP, and UP; for carton filling and sealing machines made by Haskon, Inc. (a subsidiary of Hercules, Incorporated) and known in the trade by the model designations 540U and 740U; and for a carton filling and sealing machine made by the Nimko Corporation which has a place of business in Crystal Lake, Illinois.

These various carton filling and sealing machines are typically complex and are relatively compactly designed throughout. Space is not readily available for the specific branders disclosed in my previous patent applications wherein the branding apparatus has no independent drive means but derives its movements from the actual movement of other elements at spaced stations of the filling and sealing machine. While similar brander unit structures can be adapted for employment in the machines specifically referred to above, the available locations for brander station placement do not readily lend themselves to mechanical cooperation with movable elements at spaced carton engaging or treating stations of the machines.

Accordingly, it has been one objective of the invention to provide date indicia brander apparatus, for carton filling and sealing machines, wherein the branders include independent driving means for brander operation in place of the derivative operation disclosed in my previous applications.

In several of the filling and sealing machines cited above, it is desirable to locate brander stations at areas of the machine where cartons are not under positive conveyor control. Instead, cartons are moved through the brander stations only as a result of pressure exerted by succeeding cartons discharging from upstream stations. Should there be a void in the carton line, no succeeding carton is present to push a branded carton from the brander station and the branded carton can be branded again (or double dated) upon operation of the brander. Such a double brand can burn through the upstanding top rib of the typical gable top carton and thereby ruin the carton, requiring it to be rejected as waste.

Previous attempts to eliminate the double dating problem have included the provision of various conveying elements for engaging and moving cartons away from the dater. Other attempts have included devices for moving the brander elements away from their operative positions. All of these, of course, have materially increased the cost and complexity of the daters or the filling and sealing with which they are used.

Accordingly, it has been a further objective of the invention to provide brander control means for eliminating the double dating of cartons without the requirement of additional carton conveying apparatus for removing cartons from the brander.

While it is desirable to prevent the double dating mentioned above, I have also recognized that expensive and complex apparatus is not required to control the brander operation, even where it is necessary to provide controls for eliminating double dating. Particularly, in my previous applications, I have recognized that movements of carton treating apparatus at one station of filling and sealing machines correspond to carton dwell periods at certain downstream or upstream carton locations. Those movements can be utilized to control the operation of a brander located at the specific corresponding dwell points along the path of the cartons. Of course, somewhat similar relationships exist in the particular filling and sealing machines specified above, however, the physical structure of their apparatus does not permit the convenient adaptation of the branders of my earlier applications to these. For example convenient brander locations in these particular machines may not be conveniently located near an upstream or downstream station having elements which are both readily accessible and which move at the proper time and in the proper direction from which operative motion of the brander can be easily derived.

Accordingly, it has been a still further object of the invention to provide a brander for carton filling and sealing apparatus wherein the brander is driven by an independent driving mechanism which is controlled by the movement or operation of carton treating apparatus at spaced stations, and wherein means are provided to prevent operation of the brander if such would result in twice branding a carton.

To these ends, the invention contemplates the use of an air cylinder for moving the operative elements of a brander together, and control means associated with moving carton treating elements at spaced stations of the carton filling and sealing machines for controlling the operation of the air cylinder and thus the brander, in response to movement of the carton treating elements. In each embodiment, the brander is located along the carton path of the machine and the control means are associated with spaced carton treating apparatus whose movements correspond to the short natural dwell of cartons at the stations where the brander is located.

The preferred embodiment of the invention comprises a brander particularly adapted for use in the Ex-Cell-O filling and sealing machine known by the model designation TP, and with slight brander mounting modifications, in the models designated by XP, YP, ZP, and HP. After cartons have been filled and sealed in these machines, they are conveyed around a turret, to a position where their upstanding rib is moved into a nip formed by two embossing rollers. One of these is a back-up roller while the other includes information such as codes, Board of Health numbers, or other identification. After running through the nip, the cartons dwell on skid rails until succeeding cartons discharging from the nip push or index the cartons along the rails. This dwell is a result of the fact that carton conveying lugs on the turret are spaced further apart than the carton width, so leaving a space between each carton.

A brander unit is located downstream of the nip and includes a dater block having protruding date slugs and means to heat the slugs. The dater block is positioned on one side of the upstanding top rib of the carton and an anvil is positioned on the other side. The anvil is mounted to the shaft on an air cylinder so that when the cylinder is actuated, the anvil presses the carton rib against the heated date slugs for branding. Placement of the brander is such that it defines a dating station in register with a carbon which is momentarily at rest during the short dwell mentioned. At this time, the cylinder is actuated to brand the carton.

In order to control the cylinder, a control means is associated with the nip so that for each revolution of a roller, the cylinder is actuated once. More specifically a cam is attached to one of the nip rollers and a valve having a cam follower is positioned adjacent the cam. When the cam engages the follower, the valve is opened to pass pressurized air from an air supply to the cylinder to operate the brander. The location of the cam and the valve is selected so that the cylinder is actuated at the time when a carton dwells in the brander station. Thus, the brander is controlled indirectly by the movement of upstream carton treating elements.

In order to prevent double branding, i.e., operation of the brander when for some reason there is a void in the following carton line which normally presses a branded carton out of the brander station, a second control valve or carton sensing valve is connected in the air line between the air supply and the first cam actuated valve. When cartons are present around the turret, they engage and open the second valve and the cam operated valve is thus operable to actuate the air cylinder. If cartons are not in correct position around the turret, the second valve is closed and no pressure air is transmitted to the cam operated valve. Even though the cam operated valve is actuated, the cylinder is not actuated and the brander is idle until additional cartons are conveyed around the turret.

Accordingly, it can be appreciated that the brander is controlled in part, and timed, by movements of upstream carton treating apparatus, and that double branding is eliminated without further mechanisms for either kicking cartons out of the brander station or withdrawing the brander.

In one alternate embodiment of the invention, a brander is provided for particular use in the Haskon model 740U filling and sealing apparatus. The structure of this brander is similar to the brander for the Ex-Cell-O TP unit and the brander is disposed at the end of the Haskon apparatus to brand the carton top ribs after the cartons have been filled and sealed. This brander, however, is controlled by an air valve actuated in turn by the movement of a top breaker apparatus which engages and pre-bends carton top structure prior to filling. The brander apparatus is located at a position such that it defines a dating station in correct register with a carton momentarily at rest during dwell of an upstream carton at the top breaker station. Cartons in the brander station remain under positive conveyor control and are removed from the station by the conveyor so that no additional control means is necessary to avoid double dating in this embodiment.

Another alternate embodiment of the invention is particularly adapted for use in the Haskon filling and sealing machine model 540U. In this filler, a brander includes a date slug containing heated dater block mounted on a leaf spring and an opposing stationary anvil. This apparatus is somewhat similar to that described in my previous U.S. Pat. application Ser. No. 405,909, but it differs in that an air cylinder is positioned to engage the leaf spring and move it to urge the dater block against the anvil for branding.

The brander is positioned in the filling and sealing machine just downstream of a top breaker station but upstream of the carton filler station. It is thus located to brand one upstanding carton panel which, together with another like panel, will form part of the carton's top rib when the carton is finally sealed.

As in the other embodiments, the brander apparatus defines a dating station located along the carton path at a point where cartons temporarily dwell. In this embodiment, this dwell is timed with the dwell of upstream cartons at the top breaker station. During this dwell, the brander is actuated by the air cylinder to apply the brand. Specifically, the cylinder is controlled by a button valve which is mounted on the machine to cooperate with a movable element of the machine's top breaker. As the top breaker moves toward a dwelling carton in order to pre-bend the carton's top structure, one of the moving elements of the breaker engages the button valve which actuates the cylinder to operate the brander. Since the carton dwell under the top breaker is simultaneous with carton dwell at the brander station, the cartons in the brander station are branded in response to movement of the carton treating top breaker. The branded cartons are under positive conveyor control so no additional control means is necessary to prevent double branding.

In a further alternate embodiment, the invention provides a brander for utilization in an Ex-Cell-O model UP filling and sealing machine. Essentially, the brander structure of this embodiment is somewhat similar to the brander provided for the Haskon model 540U. The difference is that the brander of this embodiment is located to apply a brand to a carton panel just downstream of the filler station and upstream of the sealing station. Also, this embodiment is controlled differently than the brander for the Haskon machine. Specifically, the brander apparatus defines a dating station in which positively driven cartons dwell at the same time a cylinder actuated hook is moved to strip upstream cartons from carton supporting mandrels used during carton bottom forming. The brander is actuated by an air cylinder which is actuated, in turn, through a common air pressure line connected to drive both the carton hook cylinder for stripping cartons from the mandrels and the brander cylinder. In operation, when the mandrel dwells at a discharge station, downstream cartons in the brander station also dwell and pressurized air in the common pressure line actuates both the carton removing hook and brander cylinder. There is no double dating problem in this embodiment since cartons are positively driven, by a conveyor, from the brander station.

In yet a further alternate embodiment, the invention provides a brander for use in a Nimko filling and sealing machine. The brander apparatus of this embodiment is similar to the brander apparatus for the Ex-Cell-O model TP in that the anvil is mounted to the shaft of an air cylinder, opposite a heated dater block. In this embodiment, however, the brander is located at the end of the machine downstream of reciprocating closure forming sealer jaws. Control of the brander air cylinder is provided by a button valve mounted for engagement with a shaft extending from the final reciprocating sealer jaw of the machine. When the jaw is closed, the valve is opened to transmit pressurized air from an air source to the cylinder to actuate the cylinder to brand a downstream carton. Similarly to the previous embodiments, the brander station is located at a point where cartons dwell at the same time cartons dwell at a spaced carton treating station (in this case, the sealer station).

Also, pressure of cartons discharging from the sealer jaws is utilized to remove branded cartons from the brander station and control means to prevent double branding is provided. To prevent double branding, a second carton sensing valve is positioned to sense the presence of a carton at the final sealer jaw station. The valve is located in the air line between the first valve and the cylinder so that when closed, no air can be transmitted to the cylinder. Thus, if no carton is present at the sealer jaw station, no air is transmitted to the cylinder and the brander is not operated. A sealed carton will thus not receive any brand until a subsequent carton is finally sealed and is in a position to push the branded carton out of the brander on the next indexing movement of the machine.

It can thus be appreciated that the present invention provides a brander for cartons wherein the brander is provided with an independent driving means controlled in response or simultaneously to movements of spaced carton treating apparatus. The brander apparatus is located to define a dating station at or in a registered location corresponding to carton swell times at the particular carton treating stations. Further, double branding is effectively prevented in those embodiments where branding is performed on cartons which are not under positive conveyor control.

These and other objects and advantages will become readily apparent from the following detailed description of preferred and alternate embodiments and from the drawings in which.

Figure 5:
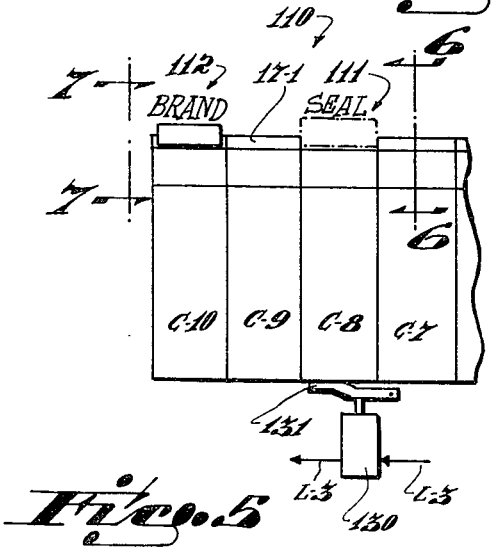
Figure 6:
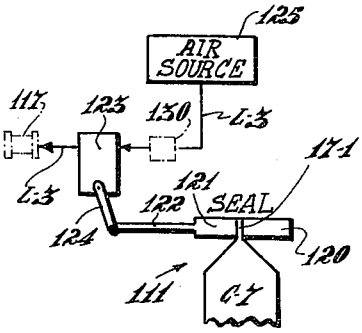
Figure 7:
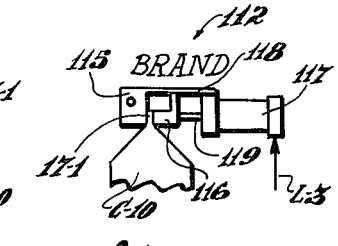
Figure 8:
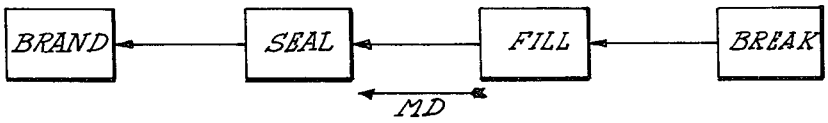
Figure 9:
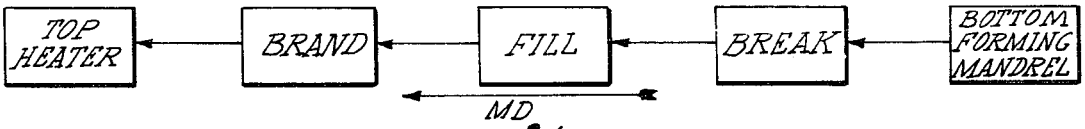
Figure 10:
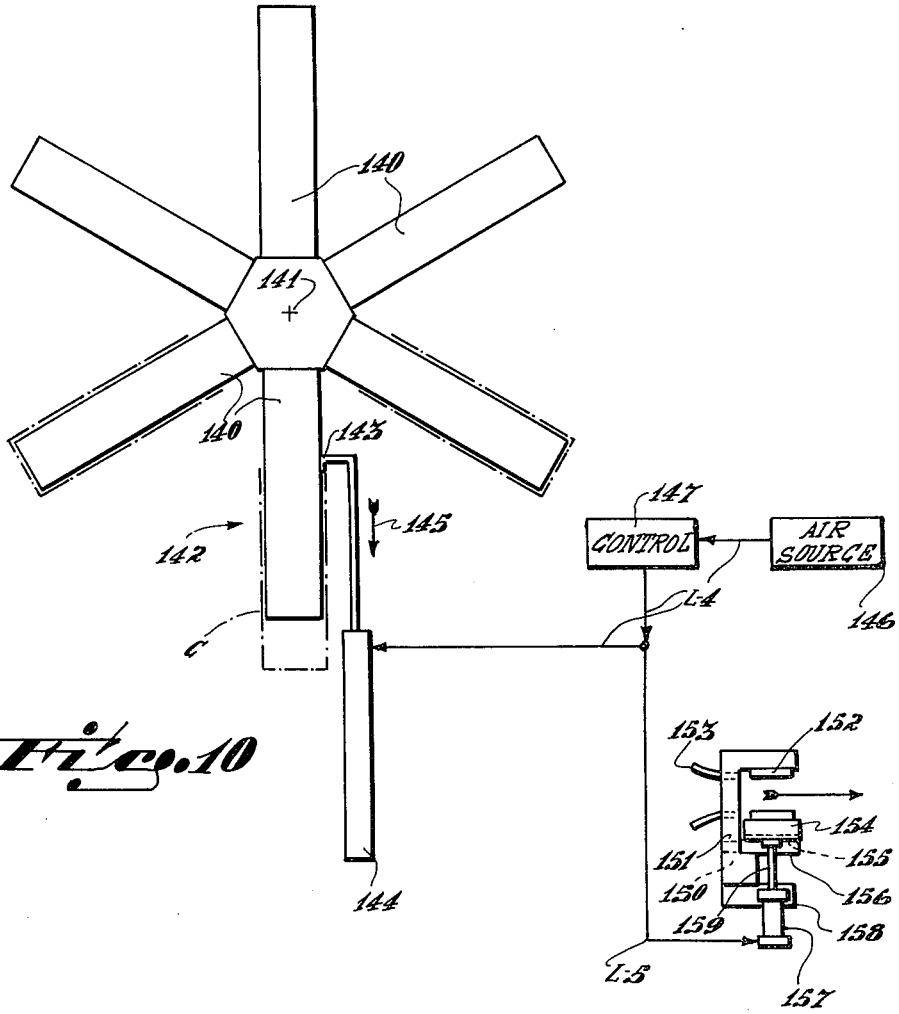

FIGS. 5 through 7 are diagramatic views of various portions of an alternate embodiment of the invention specifically adapted for use with a Nimko filling and sealing apparatus, FIG. 6 being taken along line 6—6 of FIG. 5 and FIG. 7 along line 7—7 of FIG. 5:

FIG. 8 is a diagramatic flow chart of the top breaking, carton filling, sealing, and branding stations of a Haskon "740U" filling and sealing apparatus for which one alternate embodiment of the invention is adapted:

FIG. 9 is a diagramatic illustration of the location of a brander according to the invention specifically adapted for use in an Ex-Cell-O "U.P." filling and sealing machine:

FIG. 10 is a diagramatic illustration of the carton forming mandrels and the carton stripping mechanism utilized in connection with controlling a brander in an Ex-Cell-O "U.P." filling and sealing machine.

While the following will include a description of a preferred embodiment and a number of alternate embodiments of the invention, the invention contemplates broadly in each of these a brander apparatus having independent drive means for moving one of an anvil or a dater block toward the other and control means cooperating with a spaced carton treating means to actuate the drive means in response to movements or operation of the carton treating means. The term, carton treating means, is used herein to define means for engaging cartons or performing some operation on cartons such as, for example, a top breaker, a stripper hook, a sealer jaw or the roller of a carton engaging nip, all of which are hereinafter discussed in connection with embodiments of the invention.

It should also be understood that each embodiment will be described, but without limitation, in connection with the application of a branded date indicia to at least a panel of a liquid container or carton typical of those having a gable top end closure terminating in an upstanding rib formed from a plurality of carton panels in adjacent parallel planes. Such cartons are generally made from a thermoplastic coated paperboard; the top and bottom closures are formed by heating respective top and bottom panels and pressing appropriate ones together to form the seal. Such cartons are well known and are believed to be in widespread use by many dairies.

Figure 1:
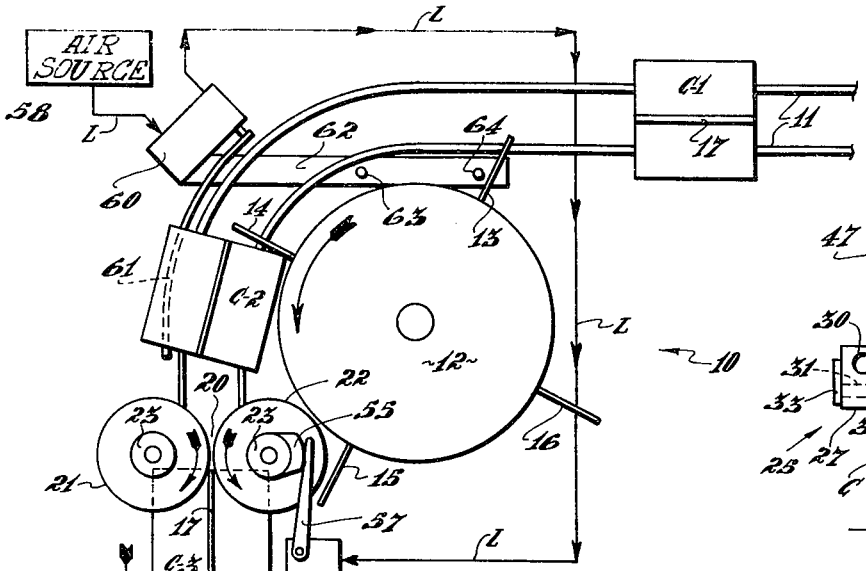
FIG. 1 is a diagramatic plan view of a preferred embodiment of the invention.
Figure 2:
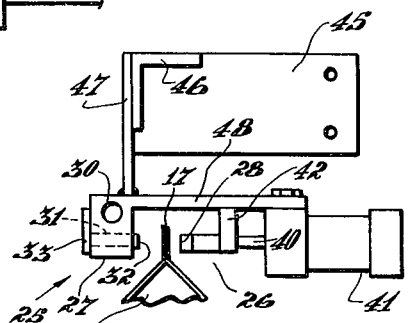
FIG. 2 is a diagramatic elevational view of a branding station of the preferred embodiment of the invention and taken along the lines 2—2 of FIG. 1.

Turning now particularly to the drawings, FIG. 1 and FIG. 2 thereof diagramatically show a preferred embodiment of the invention particularly adapted for use with a milk carton filling and sealing apparatus such as that manufactured by the Ex-Cell-O Corporation and marketed under the model designation "T.P.." In this embodiment, cartons are first formed, filled and sealed and are then conveyed around a turret prior to engagement to their top ribs in a rotary nip, after which they are branded.

The particular brander structure for this filling and sealing machine, and including the brander driving means and the brander control means, can also be easily adapted for use in the Ex-Cell-O Corporation's filling and sealing machines marketed under the model designations "X.P.," "V.P.," "Z.P." and "H.P." Each of these treats cartons as described above and only slight mounting bracket modifications for the brander structure may be required, as will be readily apparent.

With particular reference to the "T.P." model, a portion 10 of such is shown in FIG. 1 wherein cartons C are slidably supported on spaced rails 11. The cartons are conveyed toward a carton driving turret 12 which includes carton engaging lugs 13 through 16.

As shown diagramatically in the drawings, each of the cartons C at this point in the machine have been filled and have a sealed gable top structure which is typical of the coated paperboard carbons now in widespread use. Such top structure includes an upstanding rib 17 which is comprised of a plurality of carton panels located in adjacent parallel planes.

Each of the Ex-Cell-O filling and sealing machines specified above includes a rotary nip 20 which is defined by driven carton rib-engaging rollers 21 and 22. These rollers are driven and are disposed so that when cartons are urged toward the rollers, the top ribs 17 of the carton are engaged by the rollers and are conveyed through the nip 20 by rotation of the rollers. In use, the rollers can be supplied with embossing means for impressing certain information on the upstanding rib 17 of the cartons, such as, for example, Board of Health codes and the like. The rollers each have an upper shoulder or boss 23 extending upwardly therefrom as will later be described.

After the cartons have been conveyed through the nip 20, there is no further carton conveying structure per se for moving the cartons along the rails 11. The cartons are moved forwardly, however, and in the direction of the arrow A only by the pressure of succeeding upstream cartons being driven through and discharging from the nip 20.

As shown in the drawings, the spacing of the turret lugs 13 through 16 is such that cartons are spaced apart as they are conveyed by the turret lugs. Since the cartons engaged by the turret are spaced apart the cartons downstream of the nip 20 are moved incrementally, and rest until a succeeding carton is driven through the hip. During this rest or dwell interval, a brander is actuated to imply a brand to the upstanding rib 17 of a carton downstream of the nip.

In FIG. 1, a dating or brander station 25 is particularly defined by an anvil means 26 and a dater block means 27. The anvil means 26 includes an elongated forward face 28 for engaging one panel of the upstanding rib 17. The dater block 27 is an elongated member having a bore 30 running therethrough and a transverse slot 31. Date slugs, having protruding date indicia such as raised numerals 32 extending outwardly of the dater block 27 and toward the upstanding rib 17 of the carton, are inserted into the slot 31. The dater block further includes a pivoted gate 33 for locking the slugs and date indicia 32 in place.

The bore 30 is provided within the dater block to provide a cavity for receiving an electrical cylindrical heater (not shown) which can be activated to heat the dater block and the dating indicia 32. In this and in the other embodiments, any suitable heater is utilized, such as the 350 watt, 120 volt cartridge heater made by the Fast Heat Manufacturing Company and identified by the Company's catalogue number H5-24. The heater is appropriately connected through an electrical circuit to electrical control means such as a power-stat, which is operable to control the heater's output temperature. A power-stat such as the one sold by the Superior Electrical Company as its Type 21 has been found to be suitable.

The power-stat is connected to a source of electrical energy through the same circuitry used to energize the other heaters utilized in the filling and sealing apparatus for the heat sealing of the carton bottom and top structures. The heaters are thus energized whenever the apparatus is operated and serve to heat the complete dater block and the dies or slugs so that the raised numberals on the slugs are also elevated in terperature. When the raised numerals are thus pressed against the top panel of the carton, they not only emboss but also burn the thermoplastic coating and the paperboard and thereby apply dates by branding the carton with the particular date selected. The darkness of the brand on the carton panel can be adjusted by regulating the heat output of the heater by the power-stat and it has been found that the brand darkness can be adjusted to provide a highly visible and indelible marking on the carton panel.

The particular structure of the dater block means and anvil means of the embodiments herein is more particularly described in my prior U.S. Pat. applications, Ser. Nos. 405,909, filed Oct. 12, 1973, entitled "Carton Dating Apparatus" and 422,886 filed Dec. 7, 1973, entitled "Carton Branding Apparatus" and the subject matter of those applications is incorporated herein by reference.

Each of the dater block means has a projection (not shown) which engages the date slugs. When the heater is energized and the dater block means 27 is heated, the projection is also elevated in temperature and, since it engages the slugs, it serves to conduct heat thereto forwardly of the dater block. This serves to better maintain heat in the slugs and reduces overall heater output requirements as can be appreciated.

While the construction of the dater block 27 is essentially identical to the dater blocks which are disclosed in my previous U.S. Pat. applications, in addition, however, I have also provided a carton rib guide member 34, as shown in FIG. 1, so as to partially define a wide-mouth path for the upstanding ribs of cartons. This aids in positioning the carton ribs entering the dating station. To the same end, I have also provided beveled surfaces 35 which diverge from the elongated anvil surface 28. The forward surface 35, as shown in FIG. 1, combines with the rib guide 34 to provide a wide-mouth path for the carton ribs entering the dater section.

When a carton C has come to rest between the dater block means 27 and the anvil means 26, the anvil is actuated to press the upstanding rib 17 of the carton against the heated date indicia 32, so as to brand the date indicia into at least one of the upstanding panels comprising the rib. While either of the anvil means or dater block means could be mounted for movement toward the other, I have preferred to mount the dater block means 27 in a stationary manner and to movably mount the anvil means 26 so that the anvil is moved against the rib to press it against the date indicia 32.

To accomplish this, the anvil means 26 is connected to the shaft 40 of an air cylinder 41. Air cylinder 41 is of any suitable kind and preferably of the spring-loaded type wherein the cylinder 41 is spring-loaded. The shaft 40 is projected outwardly of the cylinder, against spring bias, upon the application of pressurized air thereto; the spring is utilized to retract the shaft 40 in the absence of pressurized air supplied to the cylinder.

The anvil means 26 and the dater block means 27 are both mounted to the filling and sealing apparatus via mounting bracket means which permit the correct position of the dating station with respect to the cartons discharging from the nip 20. Particularly, the brander station is mounted in a position to brand the third carton C-5 from the nip 20.

The mounting bracket means for the anvil means and dater block means comprises a mounting plate 45, an angular, member 46 connected to the plate 45, and a depending support member 47 which is connected to the dater block means such as by welding. A horizontal plate or bracket 48 is welded to the dater block and to the depending support 47 and the air cylinder 41 is connected to an opposite end of the bracket 48. When the brander apparatus, as shown in FIG. 2, is installed on the filling and sealing apparatus, a carton is set on the spaced rails 11 and the brander apparatus is aligned with respect to the carton and then the plate 45 is connected to the filling and sealing apparatus.

In order to keep the shaft 40 of the air cylinder from rotating as the shaft is extended and retracted, a shaft guide means or plate 42 is connected to the end of the shaft and is of such a length as to slidably engage the underside of the bracket 48. As shown in FIG. 1, the top of the guide means or plate 42 is somewhat elongated so that rotation of the shaft 40 is inhibited by the engagement of the guide means 42 with the underside of the bracket 48.

Operation of the brander station and of the air cylinder 41 in the Ex-Cell-O "T.P." is controlled in response to rotational movement of the roller 22. In other models, roller 21 may be used to control the brander operation.

More particularly, a cam 55 is secured against the shoulder 23 and on the upper flat surface of the roller 22. A first air valve 56 includes a cam follower arm 57 and the valve and arm are disposed so that the arm is in a position to be pivoted by rotation of the roller 22 and the cam 55. When the cam engages the arm 57, the valve 56 is opened and is thus operable to transmit air under pressure from a pressurized or compressed air source 58 to the air cylinder 41 through appropriate air pressure lines L. Transmission of pressurized air to the cylinder causes the cylinder shaft 40 to be extended therefrom and thus urges the anvil means 26 against the rib 17 so that the rib is pressed against the heated date indicia 32 and is branded. When the cam is slightly rotated beyond its arm actuating position, the arm 57 returns to a valve-closed position, thereby closing off the pressurized air to the air cylinder. The spring-loaded cylinder shaft 40 is then retracted into the cylinder and the anvil is withdrawn from the rib 17 thereby allowing the carton to be conveyed out of the brander station by the pressure of succeeding cartons discharging from the nip. Of course, an electric solenoid valve, having a switch operated by carton treating means, could be used in place of the manually operated valve in both this and the following embodiments where a valve is used to control the brander cylinder.

In the filling and sealing machines of the type described, there is always a possibility of a void in the carton line, such as shown, for example, in FIG. 1, wherein no carton is in a position to be conveyed toward the nip 20 by the lug 13. Such a void can be caused by any number of reasons such as jams or malfunctions in the filling and sealing apparatus. If no carton is in a position to be conveyed through the nip 20, then the carton in the brander station will not be moved because there is no pressure by succeeding upstream cartons to kick it out of the brander station. Continued rotation of the driven roller 22, however, will cause the valve 56 to be opened and the air cylinder 41 to be actuated so that a second brand could be applied to an already branded carton. Such a double brand could burn completely through the rib 17 or could otherwise damage the rib or the carton top structure so that the carton and its contents would have to be rejected as waste.

This problem is eliminated by a second control valve 60 which is serially located between the air source 58 and the air cylinder 41. The second air valve 60 is in essence a carton sensing valve having a carton sensing arm 61 positioned to engage and to sense the presence of cartons immediately upstream of the nip 20. The valve 60 is conveniently mounted to the "T.P." filling and sealing apparatus by means of an elongated bracket 62 which is bolted at 63 and 64 to the hold-down bolts of the turret apparatus 12. As shown in FIG. 1, the carton C-2 is engaged by the arm 61 which is rotated downwardly by the carton C-2 and is operable to open the air valve 60 in response to the sensing of the carton C-2. In this manner, the valve 60 is maintained in an open position whenever a carton is in a position immediately upstream of the nip 20, so as to be in position for engagement by the nip and to thereafter pressure downstream cartons into and out of the brander station. If, however, no upstream cartons are sensed, brander operation with respect to a carton in the brander station is forestalled until an upstream carton is in proper position immediately upstream of the nip.

To illustrate, as carton C-2 is passed toward and into the nip 20, the roller 22 is rotated and the arm 57 is moved to a valve-closed position. The air cylinder is thus deactivated and the anvil means 26 is moved away from the upstanding rib 17 of the carton C-5. Movement of the carton C-2 through the nip presses the cartons C-3 and C-4 downstream so that carton C-4 will be moved into the brander station with its upstanding rib 17 between the anvil means 26 and the dater block means 27. The carton C-5 has been kicked out of the brander station by this movement and is pushed by carton C-4 forwardly downstream to a position where the cartons (C-5 and C-6) can be removed from the apparatus.

At this point, the turret lug 13 has now been rotated counterclockwise so that the unoccupied space between the lugs 13 and 14 is in the area of the carton sensing arm 61 of the air valve 60. Since no carton is present, however, between the lugs 13 and 14, the arm 61 moves upwardly and closes the air valve 60. No pressurized air can thus be transmitted to the air cylinder 41 despite operation of the air valve 56. Thus, even though the cam 55 is rotated to move the arm 57 into a valve-open position, the air cylinder is not actuated and a brand will not be applied to the upstanding rib of the carton C-4. Carton C-4 will thus remain unbranded until carton C-1 has been moved into position by turret lug 16 so as to engage the carton sensing arm 61. When this happens, the valve 60 is opened, valve 56 is opened by the next rotation of cam 55 and the air cylinder is actuated to brand the rib 17 of the carton C-4. Carton C-1 is then moved through the nip 20 and presses against the carton C-2, which in turn presses against the carton C-3 to move the carton C-4 out of the brander station (the carton C-3 moving into the brander station). Branding is thus continued as long as successive cartons are conveyed about the turret to be sensed by the arm 61.

In this manner, the double dating or branding of cartons is eliminated by relatively simple control means and without requiring the addition of complex carton conveying mechanisms for moving cartons out of the brander station, or other mechanisms for mechanically withdrawing the brander mechanism from the brander station. Thus, even though cartons are not under positive conveyor control, double dating is eliminated, as well as damage to any of the brander elements by actuation when no carton rib is in place to be branded.

Figure 4A:
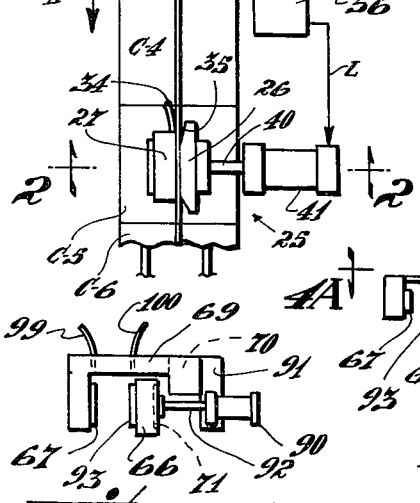
FIG. 4A is a top plan diagramatic view taken along lines *4a—4a* of FIG. 4.
Figure 4A:
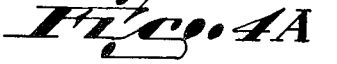
Figure 4:
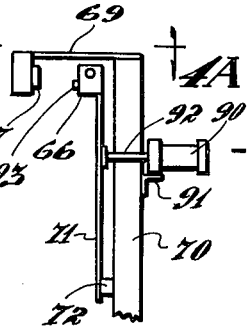
FIG. 4 is an end view of the branding station of the alternate embodiment of the invention of FIG. 3 taken along the lines 4—4 of FIG. 3.
Figure 3:
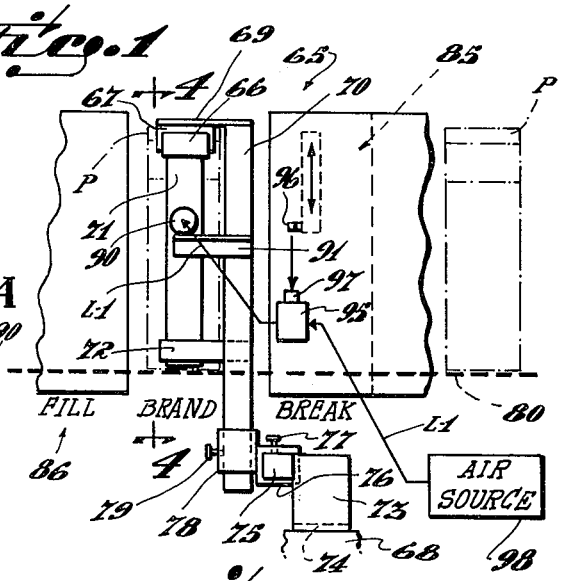
FIG. 3 is a diagramatic elevational veiw of an alternate embodiment of the invention specifically adapted for use with a Haskon "540U" filling and sealing machine.

In an alternate embodiment, depicted in FIGS. 3, 4 and 4A, the invention contemplates a carton dating or branding apparatus for applying indicia to the upstanding rib of a carton in a Haskon "540U" model filling and sealing machine 65. In this machine, the bottom structure of the carton is formed and the cartons are treated by a top breaker to prepare them for final sealing. It is between the top breaker and the carton filling station where the branded date indicia is applied to one of the carton panels P which will eventually form the top rib.

In this embodiment, the invention includes a dating or branding station defined by a dater block means 66 and an anvil means 67. The dater block is essentially similar to the dater block described in the preferred embodiment and includes a cylindrical electrical heater and protruding date indicia 93, so as to be operable to apply a branded date indicia to a carton panel. The dater block means and anvil means are mounted to the stationary portion 68 of the machine 65 in a manner similar to the mounting of the anvil means and the dater block means shown in my previous U.S. Pat. application Ser. No. 405,909.

Specifically, the anvil means 67 is mounted by way of a horizontal bracket 69 on a support column 70. The dater block means 66 is mounted on the upper end of a leaf spring 71. The lower end of the leaf spring is attached to the support column 70 by means of a bracket 72. The leaf spring is flexible so that the dater block means 66 is movable toward the anvil means 67 while the column 70, the bracket 69, and the anvil means 67 remain relatively stationary.

For adjustment purposes, the column 70 is adjustably mounted to the stationary element 68. This adjustable mounting includes a mounting plate 73 which is connected to a second mounting plate 74 bolted to stationary element 68. An elongated horizontally disposed strut or support member 75 is attached to the upper end of the plate 73. A first collar 76 is slidably mounted on strut 75 and a set screw 77 is utilized to secure the slidable collar in place, once its proper position has been determined. A second collar 78, having a vertical bore therethrough, is attached to the collar 76 and the support column 70 is inserted into the collar 78 and adjustably held against vertical movement by means of a set screw 79. As shown in FIG. 3, all of the mounting structure, including the mounting plates 73, 74 and the adjustable collar means are located beneath the carton conveyor 80 of the filling and sealing apparatus. The column 70, however, extends above the conveyor so as to mount the dater block means 66 and the anvil means 67 at a position where they are operable to brand an upstanding carton panel P of cartons conveyed through the brander station on the conveyor. When the brander of dating unit is installed, the adjustable collars are utilized to properly position the dater block means 66 and the anvil means 67 with respect to the carton, both from a vertical standpoint and from a horizontal standpoint.

In operation, cartons are indexed to the top breaker station, indicated at 85 in FIG. 3, where carton treating and engaging apparatus is moved into engagement with the top panel P of the cartons in order to "break" them along pre-scored lines and to thereby pre-bend them in preparation for later top structure forming and sealing. In this regard, the top breaker station includes a number of elements which reciprocate as the top breaker is actuated toward and away from cartons at the station.

Subsequent to top breaking, the cartons are moved downstream, where they are first branded, and then into the filler station 86 where they are filled with milk. Since the cartons are indexed intermittently to and away from the top breaker station 85, cartons immediately downstream of the carton breaker station 85 are also intermittently moved between the top breaker and the filler station, and the branding occurs here during a dwell period of the intermittent motion.

Despite the fact that the brander apparatus is located adjacent to the top breaker station, the structure of the Haskon machine does not make it convenient to use a mechanical linkage between the movable elements of the top breaker and the brander in order to actuate the brander. For this reason, independent driving means, such as that depicted by the air cylinder 90, is provided in order to actuate the brander. The air cylinder 90 is mounted on support column 70, by means of a bracket 91, and is the same as the cylinder described in connection with the preferred embodiment. The cylinder is mounted so that the end of its shaft can engage the leaf spring 71. When pressurized air is supplied to the air cylinder, the shaft 92 is extended so as to engage the leaf spring 71 and urge the dater block means 66 toward the anvil means 67, thereby pressing a carton panel P between the anvil means and the protruding data indicia 93 associated with the dater block.

In order to actuate the air cylinder, so that the brander can be operated, a control valve 95 is located in a position to be engaged by a movable element 96 of the top breaker apparatus. As the top breaker is actuated to engage a carton top, the movable element 96 engages a control button 97, of the valve 95, in order to open the valve and to pass pressurized air from a compressed air source 98 to the air cylinder 90 through appropriate air lines L-1. Thus, cartons which are temporarily at rest in the brander station are branded at the same time upstream cartons are engaged by the top breaker. Valve 95 is placed in any convenient position on the top breaker so as to be engaged upon movement of any convenient moving element of the top breaker, in timed relation to the temporary resting of the carton in brander station.

Since the cartons are under positive conveyor control, it is unnecessary to provide further control apparatus for the brander station. After branding, cartons are positively conveyed out of the branding station by the conveyor means and a second brand or date will not be applied to the carton panel P.

In order to reduce jamming by any undesired engagement of the partially bent upstanding carton panels with the brander apparatus, the anvil means 67 includes a curved guide surface 99 which diverges from the predetermined path of the carton panel to act as a panel guide. The apparatus further includes a curved panel guide 100 which is mounted on the bracket 69 and which also diverges from the carton panel path in order to form, in conjunction with the anvil surface 99, a wide-mouthed path for the receipt of cartons therebetween. In addition, and in order to prevent the anvil means from becoming over-heated, the anvil means may be water cooled as discussed in my previous U.S. Pat. application Ser. No. 405,909.

FIGS. 5, 6 and 7 diagramatically depict a further embodiment of the invention adapted for particular use in connection with the Nimko filling and sealing machine. In this particular apparatus, the brander is disposed to brand cartons immediately after they have been sealed. Cartons in the brander station are not under positive conveyor control of the filler and sealer apparatus but rather rely on the pressure of succeeding cartons discharging from the sealer, to remove them from the brander station.

Generally this embodiment contemplates the utilization of two controlling valves one of which is controlled by the reciprocation of the sealer jaw of the apparatus and the other of which is a carton sensing valve positioned to engage cartons immediately upstream of the brander and to thereby insure that a once branded carton will not be twice branded. More particularly, FIG. 5 diagramatically depicts a Nimko filling and sealing machine 110 which includes a sealing station 111 and a branding or dating station 112. The branding station is specifically defined by a dater block means 115 and an anvil means 116. The dater block means and the anvil means are like the dater block means described with regard to the preferred embodiment of the invention. The dater block means includes protruding date indicia and the anvil means is positioned opposite thereto for reciprocal movement so as to press the upstanding rib 17-1 of the gable top carton against the dating indicia. The date indicia are heated so that movement of the anvil against the carton rib causes the indicia to brand the rib.

The brander unit for the Nimko apparatus also includes an air cylinder 117, which is like the air cylinder described in connection with the preferred embodiment. The cylinder 117 is mounted on a bracket 118, which is in turn attached to the dater block means 115. This bracket or the dater block is attached to the end of the Nimko filling and sealing machine in any convenient manner (not shown) and is aligned so that the upstanding rib 17-1 of cartons which are discharged from the Nimko filling and sealing apparatus are pushed between the anvil means 116 and the dater block means 115. When an upstanding rib is so located, pressurized air is supplied to the cylinder 117 and the shaft 119 of the cylinder is actuated to move the anvil against the rib 17-1 and thereby press the rib against the heated protruding indicia to apply a brand to the rib.

Upstream of the branding station, the Nimko filling and sealing apparatus is operable to seal the cartons by heating the top panels of the cartons and pressing them together to form the rib 17-1. This compression is performed in part by a plurality of sealer jaws such as shown at 120 and 121 of FIG. 6. Sealer jaw 121 is reciprocally mounted so as to compress the carton rib 17-1 against the opposing sealer jaw 120. A shaft or other elongated element 122 extends rearwardly from the reciprocating jaw 121.

A first control valve 123 includes a valve actuating member, such as arm 124, which is positioned to be actuated by the end of the elongated member 122. When the sealer jaw 121 is in a forward position, compressing the rib 17-1 against the opposing jaw 120, the valve actuating member 124 is placed into a valve-open condition and the valve is thereby operable to transmit pressurized air from compressed air supply 125 to the air cylinder 117 via an appropriate air line L-3. This actuates the cylinder and causes the anvil means 116 to compress the carton rib 17-1 against the opposed heated date indicia. Movement of the sealer jaw away from the carton rib moves the member 124 to a valve-closed position and the shaft 119 withdraws the anvil from a branded rib.

Since the cartons within the brander station are not under positive conveyor control of the filling and sealing apparatus, it is necessary to provide means for prohibiting the doubel dating branding of the upstanding ribs 17-1 of the cartons. In this embodiment, this is accomplished by a second carton sensing control valve 130. This valve includes a carton sensing arm 131 positioned to detect the presence of a carton at the sealing station. This is the last point at which cartons are under positive conveyor control. Final conveyance of the carton C-8 from the sealing station serves to push carton C-9 into the brander station and carton C-10 out of the brander station. If for some reason there is a void in the carton line, and a position normally occupied by the carton C-7 is vacant, no carton would be conveyed to the sealing station and the carton sensing arm 131 would not actuate the valve 130. The valve 130 would thus remain closed and, since it is located serially in the air line L-3 between the air supply 125 and the cylinder 117, the cylinder would not be actuated to apply a brand to the carton C-9, despite the normally actuating movement of the sealer jaw 121 and of the actuating element 124 of the first control valve. Carton C-9 would only receive a brand when the next carton in the line actually moved into the sealer station. Double dating of cartons in the branding station is thus eliminated until succeeding cartons are in a position to kick a once branded carton out of the brander station.

In still a further embodiment, the invention contemplates a dating apparatus for another filling and sealing machine made by the Haskon Company and designated as its model "740U." As shown in FIG. 8, by the arrow marked MD for machine direction, cartons in this apparatus are run through a top breaking station for pre-bending their top structure along the score lines provided on the upper portions of the carton panels, through a filling station, through a sealing station, and then through a branding station where data indicia are applied to the upstanding rib of the cartons. In this particular filling and sealing apparatus, the brander station is composed of the same elements as the brander of the preferred embodiment which is particularly adapted for use in the Ex-Cell-O "T.P." filler and sealer. These are mounted on the end of the Haskon "740U" in any suitable manner. While the structure of the brander elements for the Haskon "740U," including the dater block means, the anvil means and the air cylinder for driving the anvil means, are all like the brander for the Ex-Cell-O "T.P." unit, the control for the brander is like the control provided for the brander particularly adapted for the Haskon "540U" filler and sealer, such as shown in FIGS. 3, 4 and 4A of the drawings, and includes an air control valve.

Specifically, cartons downstream of the sealing station of the Haskon "740U" dwell intermittently and in timed relation with the upstream top breaker operation. The air cylinder control valve of this embodiment is thus positioned for actuation by a reciprocating element of the Haskon "740U" top breaker. When the valve is actuated by reciprocation of the element to an open position, the brander cylinder is actuated to drive the anvil means against an upstanding carton rib and press it against heated date indicia to apply a brand thereto. Thus this embodiment is located at the end of the Haskon "740U" and brands cartons discharging from the apparatus in response to the movement of the spaced upstream top breaking station. Further, the branding station is located in a position immediately following the sealing station of the "740U" apparatus so that cartons conveyed through the brannding station are still under positive conveyor control of the apparatus, and it is unnecessary to provide additional control means to prevent the double dating of cartons in the dating station.

It can thus be appreciated that the brander for the Haskon "740U" model is in a position to brand cartons in direct response to the operation of the filling and sealing apparatus and that the branding station is located in a position so that cartons temporarily rest in the brander at the same time cartons are disposed for treatment by the upstream top breaker station.

In a still further alternate embodiment, the invention contemplates a brander apparatus which is particularly adapted for use in an Ex-Cell-O filling and sealing machine of the type known under the model designation "U.P.". In this filling and sealing apparatus, a brander station is located in a position to apply dates to carton panels after the cartons have been filled out before the cartons are moved through a top heater station which heats the top carton panels prior to sealing thereof.

FIG. 9 generally depicts the disposition of the brander station with respect to other stations in the "U.P." filling and sealing apparatus. Cartons are fed from a magazine (not shown) onto mandrels 140 for the purpose of forming the bottom structure of the cartons. As depicted in FIG. 10, the mandrels 140 are radially disposed for rotation about a horizontal axis 141. Coated paperboard tubes are placed on the mandrels and as the mandrels are indexed, various operations are performed on the outward ends of the tube in order to seal the carton bottom structure.

When this has been done, the cartons are indexed to a discharge position such as shown in 142 in FIG. 10. At this position, a carton stripping means such as hook 143 is actuated by an air cylinder 144, in the direction of arrow 145, in order to engage and pull cartons from the mandrel. The air cylinder 144 is actuated by pressure air transmitted thereto from a source of compressed air 146. Air is intermittently applied to the cylinder 144 by a pressure air control means 147 located in the air line L-4 and including timing means for actuating the cylinder 144 at the proper time when the mandrel is located in a discharge position.

From the bottom forming station, the cartons are discharged to a top breaking station, as depicted in FIG. 9, for pre-bending the carton tops along the score lines prior to filling. From the top breaking stations, the cartons are conveyed to a filling station where they are filled. Thereafter, the cartons are moved to a branding or dating station where a date is applied to an upstanding carton panel. From the dating station, the cartons are then moved, under positive conveyor control, out of the station and into a top heating station where the top panels are heated prior to top structure forming, (wherein the branded panel is compressed against an adjacent panel to form an upstanding carton rib).

Essentially, the brander apparatus and mounting structure is similar to that shown in FIGS. 3, 4 and 4A of the drawings, with the exception, however, that the brander is located on the opposite side of the carton lines as the cartons move through the machine, as indicated in FIG. 10. Particularly, the brander apparatus includes a support column 150, a bracket 151 attached to the top of the support column and an anvil means 152 mounted to the bracket. The anvil means has a forward curved surface 153 serving as a carton panel guide as cartons are moved into the brander station.

The brander apparatus also includes a dater block means 154, having protruding date indicia, and including a heating means (not shown) all of which is according to the dater block apparatus as shown in my previous U.S. Pat. application Ser. No. 405,909. The dater block means 154 is mounted at the upper end of the leaf spring 155, which is attached at its lower end, by means of a bracket 156, to the support column 150.

An independent driving means or air cylinder 157 is also mounted to the support column, by means of a bracket 158, in a position so that an air cylinder shaft 159 can be extended upon the application of compressed air to the cylinder so as to engage the leaf spring and urge the dater block and the protruding date indicia toward the anvil. The support column is mounted to the "U.P." apparatus similarly to the adjustable mounting as shown in FIG. 3, or in any other convenient manner.

In the "U.P." apparatus, the brander is located at a point adjacent a path along which cartons are conveyed, such that cartons dwell in the brander station at the same time a mandrel 140 is located in a discharge position 142. Thus, at the same time the stripper hook actuating cylinder 144 is activated to move the hook to strip cartons from the mandrel, a downstream carton has an upstanding carton panel located between the dater block means and the anvil means of the brander.

In order to activate the brander, a pressure line L-5 is connected to the air line L-4 so that pressurized air is applied to the air cylinder 157 at the same time pressurized air is applied to the cylinder 144. By this means the dater block is urged against the upstanding carton panel at the same time upstream cartons are stripped from mandrels at a discharge station. Since cartons are under positive conveyor control and are removed from the brander by the conveyor, it is unnecessary to provide additional control means for eliminating the possibility of twice branding cartons in the brander station.

Thus it can be seen that in the preferred and in each of the alternate embodiments, the invention contemplates a brander apparatus which is provided with independent driving means, actuated by movement or operation of related container or carton treating apparatus located at spaced stations in the filling and sealing apparatus with which the particular brander is associated. In those filling and sealing machines where cartons are not under positive conveyor control at the time they are branded, the invention further contemplates additional control means for eliminating the possibility of applying a second brand to the same carton panel. Thus damaged cartons which would be rejected and wasted are eliminated without substantial additional expense for independent carton conveyors associated with these branders.

Each of the branders contemplated by the invention is located in a particular filling and sealing apparatus so that a carton conveyed to a brander station can be branded in timed relationship with the motion of carton treating apparatus at unrelated spaced stations of the filling and sealing machine. Thereby, the necessity for additional expensive or complex timing apparatus is eliminated.

These and other alterations and modifications will become readily apparent to one of ordinary skill without departing from the scope of the invention, and applicant intends to be bound by the following claims appended.

I claim:

1. In carton filling and sealing apparatus of the type having carton treating means for directly engaging and treating cartons successively conveyed thereto, said cartons being of the type having a gable top end closure including a top rib formed from a plurality of panels disposed in adjacent parallel planes, dating apparatus for applying branded indicia to at least one of said panels and comprising:

anvil means, dater block means having indicia applying means aligned with and normally spaced from said anvil means, said anvil means and said dater block means being mounted so that one is relatively movable toward and away from the other, and defining a dating station, driving means for moving one of said anvil means and said dater block means toward the other to apply indicia to a carton panel, said filling and sealing apparatus having means for moving at least one of said panels between said anvil means and said dater block means, and control means associated and cooperating with said carton treating means for actuating said driving means to move one of said anvil means and said dater block means toward the other in direct response to movement of said carton treating means so as to apply a date on one of said panels when said one panel is between said anvil means and said dater block means.

2. Dating apparatus as in claim 1 wherein said carton treating means comprises a rib engaging nip means defined by two rotating rollers disposed to engage opposite sides of a rib at a carton engaging station and wherein said dating station is immediately downstream of said nip means.

3. Apparatus as in claim 2 wherein said driving means comprises an air cylinder selectively connected through an air line to a source of pressurized air by said control means which includes a first air valve.

4. Apparatus as in claim 3 wherein said control means includes a cam attached to one of said rollers, and a cam follower attached to said air valve for opening said valve to actuate said cylinder when said cam follower is engaged by said cam.

5. Dating apparatus as in claim 4 wherein cartons are pushed into and out of said dating station by pressure of succeeding cartons discharging from said nip means, and including means for sensing upstream of said nip and for rendering said driving means inoperative when no cartons are sensed.

6. Apparatus as in claim 5 wherein said control means includes a second air valve, said second air valve connected serially in said air line between said cylinder and said source of pressurized air and having an actuating arm disposed to engage cartons immediately upstream of said carton engaging station, said second air valve opening said air line between said cylinder and said source of pressurized air, when said arm is engaged by cartons, and closing the air line to said cylinder in the absence of cartons engaging said arm, in order to prevent operation of said brander independently of the operation of the first air valve.

7. Apparatus as in claim 4 wherein said cam and said cam follower are relatively disposed to actuate said first air valve and thus said cylinder when a carton rib is between said anvil means and said dater block means.

8. Apparatus as in claim 2 wherein cartons are pushed into and out of said dating station by the presence of upstream cartons discharging from said nip means pushing thereagainst, said controlling means actuating said driving means to brand a carton at the carton dating station in response to rotation of said rollers.

9. Apparatus as in claim 8 wherein said control means includes means for sensing cartons immediately upstream of said carton engaging station, and for rendering said driving means inoperable in the absence of cartons immediately upstream of said carton engaging station in order to prevent twice branding a carton at said dating station and independently of the rotation of said rollers.

10. Apparatus as in claim 2 wherein said driving means includes an air cylinder, and further including, a cam mounted on one of said rollers, a source of pressurized air connected by a pressure line to said cylinder, and wherein said control means includes a first air valve connected in said air line between said air source and said cylinder, said first valve having a movable actuating element disposed for engagement and operation by said cam during rotation of said roller to operate said valve and thereby transmit pressurized air to said cylinder to cause it to operate.

11. Apparatus as in claim 10 wherein said control means includes a second air valve, a carton sensing arm connected to said second valve and disposed to sense cartons immediately upstream of said carton engaging station, said second valve being connected in said pressure line to render said cylinder inoperable, in the absence of cartons immediately upstream of said carton engaging station, and independently of the rotation of said rollers.

12. Apparatus as in claim 10 wherein said dater block means is stationarily mounted and wherein said anvil means is mounted on a shaft of said air cylinder.

13. Apparatus as in claim 1 including a curved carton panel guide on said dater block means and a diverging cam surface on said anvil means, said guide and said diverging cam surface forming a wide-mouth path for upstanding top portions of cartons conveyed toward said dater block means and said anvil means.

14. Apparatus as in claim 1 wherein said dater block means includes a slot for receiving changeable date slugs, gate means for blocking said slot and securing said date slugs therein, a bore, and heater means disposed within said bore for heating said date slugs for branding.

15. Apparatus as in claim 1 wherein said driving means includes, an air cylinder, a bracket, said air cylinder being mounted on said bracket, said anvil means mounted on a reciprocable shaft extending from said air cylinder, and said dater block means connected to said bracket.

16. Apparatus as in claim 15 including an air cylinder shaft guide means connected to said shaft and slidably engaging said bracket for preventing rotation of said shaft and said anvil means.

17. Dating apparatus as in claim 1 wherein said carton treating means comprises a top breaker and wherein said dating station is disposed downstream of said top breaker and upstream of carton filling means in said filling and sealing apparatus.

18. Dating apparatus as in claim 1 wherein said carton treating means comprises a top breaker and wherein said dating station is disposed downstream of means for forming and sealing said carton top end closure.

19. Dating apparatus as in claim 1 wherein said carton treating means comprises closure forming sealer jaws at a sealing station for sealing carton panels together to form said rib and wherein said dating station is disposed downstream of said sealer jaws.

20. Dating apparatus as in claim 19 wherein cartons are pushed into and out of said dating station by the pressure of succeeding cartons discharging from said sealing station and including means for sensing cartons in said station and for rendering said drive means inoperative if no cartons are sensed.

21. In apparatus for filling and sealing tubular milk cartons having gable top end closures terminating in a top rib which includes a plurality of panels disposed adjacent parallel planes, said apparatus being of the type having a carton conveyor and a rotating, rib engaging, nip means for engaging opposite sides of said rib after said cartons have been filled and sealed, dating apparatus for applying branded indicia to at least one of said panels after rib engagement by said nip means, said dating apparatus including:

anvil means, dater block means having indicia applying means aligned with and normally spaced from said anvil means, means associated with said dater block means for heating said indicia applying means, said dater block means and said anvil means being mounted so that one is relatively movable toward and away from the other, said filling and sealing apparatus including a carton engaging member for transferring successive cartons into said nip means, cartons discharging from said nip means pushing downstream cartons between said dater block means and said anvil means such that a rib is disposed between said anvil means and said dater block means, means for driving one of said anvil means and said dater block means toward the other, and control means associated with and connected to said nip means for actuating said driving means in direct response to movement of said rotating rib engaging nip means.

22. Apparatus as in claim 21 including means for rendering said driving means inoperative when no cartons are in a position to be transferred into said nip means.

23. Apparatus as in claim 22 wherein said nip means comprises two rotatable rollers, wherein said driving means includes an air cylinder, and further including, a source of pressurized air connected to said cylinder through a pressure air line, a cam attached to one of said rollers, and a first air valve connected in said pressure line between said air source and said cylinder, said first air valve having a cam follower disposed to engage said cam when said roller rotates and to open said valve to pass pressurized air to said cylinder in order to operate said cylinder to brand a carton.

24. Apparatus as in claim 23 including a second air valve connected in said air line between said pressurized air source and said cylinder, said second air valve including:

a valve actuating arm disposed to engage cartons between said carton engaging member for transferring cartons into said nip means and said nip means, said second air valve being operable closing said line, when said valve actuating arm does not engage a carton, in order to prevent operation of said air cylinder and the double branding of a rib between said anvil means and said dater block means.

25. In apparatus for filling and sealing tubular milk cartons having gable top end closures terminating in a top rib which includes a plurality of panels disposed in adjacent parallel planes, said apparatus being of the type having a carton conveyor and two rollers forming a rotating, rib engaging, nip means for engaging opposite sides of said rib after said cartons have been filled and sealed, dating apparatus for applying branded indicia to at least one of said panels after rib engagement by said nip means, said dating apparatus including:

an anvil, a dater block including indicia applying means, said anvil and dater block being disposed on opposite sides of at least a portion of a carton, control means associated with and connected to one of said rollers, and drive means controlled by said control means in direct response to rotation of one of said rollers for moving one of said anvil and said dater block relatively toward and away from the other to apply said indicia to a carton in response to rotation of said roller.

26. Apparatus as in claim 25 further including means to sense the presence of cartons upstream of said nip means and to render said drive means inoperative, independently of continued roller rotation, when no cartons are sensed.

27. Apparatus as in claim 26 including means associated with said dater block for heating said indicia applying means.

28. In apparatus for filling and sealing tubular milk cartons having gable top end closures terminating in a top rib which includes a plurality of panels disposed in adjacent parallel planes, said apparatus being of the type having a carton conveyor and a reciprocating top breaker means, including a movable member, for engaging and pre-bending carton top structure preparatory to filling said cartons and to sealing said top structure to form said gable top end closure, and said apparatus including means for conveying a line of cartons therethrough, dating apparatus for applying branded indicia to at least one of said panels after said pre-bending, and before said filling, said dating apparatus including:

anvil means, dater block means including indicia applying means, said anvil means and said dater block means defining a dating station, a leaf spring mounted on said fillng and sealing apparatus in proximity to said line of cartons, one of said anvil means or said dater block means being attached to said leaf spring at a point spaced from said spring's attachment to said apparatus, said anvil means and said dater block means being aligned and normally spaced apart with respect to each other and disposed so that carton panels can be conveyed therebetween, driving means for moving one of said anvil means and said dater block means on said leaf spring relatively toward the other, and control means cooperative with said top breaker means on said filling and sealing apparatus for actuating said driving means to move one of said anvil means or said dater block means on said leaf spring toward the other in order to engage and to apply indicia to a carton panel between said anvil means and said dater block means in response to movement of said movable member.

29. Apparatus as in claim 28 wherein said driving means comprises an air cylinder having a reciprocable shaft disposed to move said leaf spring.

30. Apparatus as in claim 29 including a source of pressurized air connected to said air cylinder by a pressure air line, said control means including an air valve in said line for selectively opening said line to pass pressurized air to said cylinder.

31. Apparatus as in claim 30 wherein said air valve includes an actuating element disposed for engagement by the movable element of said top breaker, when said top breaker is actuated to engage carton top structure, in order to open said valve and to actuate said cylinder and date cartons at the dating station.

32. Apparatus as in claim 31 wherein said dating station is located downstream of said top breaker means but upstream of apparatus for filling and sealing cartons.

33. Apparatus as in claim 32 wherein said conveying means is operable to convey a carton rib to a position between said anvil means and said dater block means at the same time a carton is located beneath said top breaker for pre-bending.

34. Apparatus as in claim 29 wherein said dater block means is mounted on said leaf spring.

35. Apparatus as in claim 29 wherein said dater block means includes means for heating said indicia applying means so that indicia can be branded into said cartons.

36. Apparatus as in claim 29 wherein said dating apparatus further includes an elongated support column connectable to said filling and sealing apparatus.

37. Apparatus as in claim 36 wherein said elongated support column has a lower end disposed beneath said conveying means, and wherein said anvil means and said dater block are mounted near an upper end of said elongated support column, elevated above said conveying means so as to be in operative proximity to a top portion of cartons conveyed by said conveying means.

38. Apparatus as in claim 37 wherein said elongated support column is adjustably mounted on said filling and sealing apparatus at a lower end of said column so as to provide horizontal and vertical adjustment of said anvil means and said dater block means with respect to said conveying means and said conveyed cartons.

39. Apparatus as in claim 38 including a horizontal support strut, attached to said filling and sealing apparatus, and to which said support column is mounted, a first movable collar slidably mounted on said strut, a second collar attached to said first collar and having a vertical bore therethrough, said support column adjustably disposed within said vertical bore and extending upwardly therefrom, said anvil mounted on said column, means attaching a bottom portion of said leaf spring to said column, and means mounting said air cylinder on said column in a position to engage said leaf spring with said shaft.

40. Dating apparatus as in claim 28 wherein said dating station is positioned so that cartons dwell intermittently at the dating station at the same time cartons dwell upstream at the top breaker means.

41. In a carton filling and sealing apparatus of the type including means for conveying a line of cartons therethrough for forming, filling, heating and sealing, and further including, a carton mandrel for holding cartons during formation of carton bottom structure, and a first air cylinder actuated reciprocating member for stripping cartons from said mandrel, carton dating apparatus for applying branded indicia to carton panels, said dating apparatus comprising:

anvil means, dater block means including indicia applying means, said anvil means and said dater block means defining a dating station, a leaf spring attached to said filling and sealing apparatus in proximity to said line of cartons, one of said anvil means and said dater block means being attached to said leaf spring at a point spaced from said spring's attachment to said apparatus, said anvil means and said dater block means being aligned and normally spaced apart with respect to each other and disposed so that carton panels can be conveyed therebetween, driving means including a second air cylinder for moving one of said anvil means and said dater block means relatively toward the other, a source of pressurized air, and pressure air lines connecting both of said air cylinders to said air source so that each cylinder is actuated to respectively and simultaneously, strip a carton from the mandrels, and move one of said anvil means and said dater block means on said leaf spring toward the other in order to engage and to apply indicia to a carton panel between said anvil means and said dater block means.

42. Apparatus as in claim 44 wherein said dating station is located in said filling and sealing apparatus to apply indicia to cartons after they have been filled but before the top structure of the cartons has been heated preparatory to sealing.

43. Apparatus as in claim 42 wherein said dating station is located so that a top panel of a conveyed carton dwells in a position temporarily disposed between said anvil means and said dater block means when said air cylinders are actuated.

44. In apparatus for filling and sealing tubular milk cartons having gable top end closures terminating in a top rib which includes a plurality of top panels disposed in adjacent parallel planes, said apparatus being of the type having a carton conveyor and a reciprocating top breaker means for engaging and pre-bending carton tops preparatory to filling said cartons and to sealing said tops to form said gable top end closure, said top breaker means including a movable element which moves as said top breaker means moves to engage and pre-bend a carton, dating apparatus for applying branded indicia to at least one of said panels after said cartons have been filled and sealed, said dating apparatus including:

anvil means, dater block means having indicia applying means aligned with and normally spaced from said anvil means, said anvil means and said dater block means defining a dating station, said dater block means and said anvil being mounted so that one is relatively movable toward and away from the other, driving means for moving one of said anvil means and said dater block means toward and away from the other, said carton conveyor being operable to successively convey said cartons to said dating apparatus such that one of said panels is disposed between said anvil means and said dater block means, and control means cooperating with said top breaker means for actuating said driving means to move the movable one of said anvil means and said dater block means toward the other to apply indicia to said one panel in direct response to movement of said top breaker means toward an upstream carton.

45. Apparatus as in claim 44 wherein said dating station is disposed to apply said indicia to said panels after said cartons have been filled and sealed.

46. Apparatus as in claim 45 wherein said dating station is located such that a carton panel is located between said anvil means and said dater block means when said top breaker means is actuated to pre-bend an upstream carton top.

47. Apparatus as in claim 46 wherein said driving means comprises an air cylinder having a reciprocable shaft, said anvil means being mounted on said shaft.

48. Apparatus as in claim 47 including a source of pressurized air connected to said cylinder through a pressure air line, said control means including an air valve, in said air line, having an actuating arm mounted for engagement by said movable element to open said valve to actuate said cylinder and thereby apply indicia to a carton panel.

49. Apparatus as in claim 48 including means associated with said dater block means for heating said indicia applying means.

50. In carton filling and sealing apparatus of the type having reciprocating closure forming means, at a sealing station, for engaging and compressing a top rib of a gable top end closure on cartons successively conveyed thereto, said top rib formed from a plurality of carton panels disposed in adjacent parallel planes, dating apparatus for applying branded indicia to at least one of said panels after said cartons have been filled and sealed and comprising:

anvil means, dater block means having indicia applying means aligned with and normally spaced from said anvil means, said anvil means and said dater block means being mounted so that one is relatively movable toward and away from the other, and defining a dating station, said filling and sealing apparatus having means for moving at least one of said panels between said anvil means and said dater block means, driving means for moving one of said anvil means and said dater block means toward the other, and control means cooperating with said closure forming means for actuating said driving means, in direct response to movement of said closure forming means at said sealing station toward and away from the top rib of successive cartons, so as to apply a date to one of said panels when said panel is between said anvil means and said dater block means.

51. Apparatus as in claim 50 wherein cartons are pushed into said dating station by immediately upstream cartons discharging from said closure forming means, and wherein said control means further includes means for rendering said driving means inoperative in the absence of said immediately upstream cartons in order to avoid twice dating a carton panel.

52. Apparatus as in claim 51 wherein said driving means comprises an air cylinder and further including a source of pressurized air selectively connected to said cylinder through through a pressure air line.

53. Apparatus as in claim 52 wherein said control means includes a first air valve connected in said pressure line between said air source and said cylinder and wherein said closure forming means includes a sealing jaw mounted on a reciprocating member, said first air valve having a movable actuating element disposed in a position to be moved to a valve-closed position by said reciprocating member when the member is moved to withdraw said sealer jaw from a carton rib, and to be moved to a valve-opening position when said reciprocating member is moved to urge said sealer jaw against a carton rib, said valve, when opened, transmitting pressure air to said cylinder to apply indicia to a carton rib between said anvil means and said dater block means.

54. Apparatus as in claim 53 further including a second air valve connected in said pressure line, and a valve actuating arm disposed to engage at least one carton upstream of a carton at the dating station, said second air valve opening said pressure line when said arm is engaged by a carton and closing said line to render said cylinder inoperable when no cartons are engaged, in order to prevent twice dating a single carton panel in said dating station.

55. Apparatus as in claim 54 wherein said valve actuating arm of said second valve is disposed to engage cartons disposed in said sealer station.

56. Apparatus as in claim 50 wherein said closure forming means includes a carton sealing jaws and wherein said dating station is downstream of said closure forming means.

57. Apparatus as in claim 56 wherein said dating station is spaced from said closure forming means so that a carton rib is located at said dating station when an upstream carton rib is located between said carton sealing jaws for compression therebetween.

58. Apparatus as in claim 57 including means associated with said dater block means for heating said indicia applying means.

59. Apparatus as in claim 24 wherein said second air valve is mounted on an elongated bracket which is attached to said filling and sealing apparatus.

60. Apparatus as in claim 59 wherein said elongated bracket is attached to said filling and sealing apparatus beneath said carton conveyor.

61. Apparatus as in claim 60 wherein said filling and sealing apparatus includes a carton conveying turret means bolted to said filling and sealing apparatus and wherein said elongated bracket is attached to the filling and sealing apparatus by the same bolts holding said turret means thereon.

62. Apparatus for applying indicia to carton panels in carton filling and sealing machines, said apparatus comprising:

an anvil means, indicia applying means, means for mounting said anvil means and said indicia means so that one is movable toward and away from the other to compress a carton panel therebetween and to apply indicia to the panel, said mounting means including, an elongated support column adapted for mounting on said filling and sealing machines, one of said anvil means and said indicia applying means mounted to one end of said column, a leaf spring having one end mounted to said column at an area spaced from said one end of said column, said leaf spring having a second end and the other of said anvil means and said indicia applying means being mounted to said second end of said leaf spring, said anvil means and said indicia applying means being thereby operatively aligned, and said leaf spring being flexible so that one of said anvil means and said indicia applying means thereon is movable toward or away from the other when the leaf spring is flexed.

* * * * *

UNITED STATES PATENT AND TRADEMARK OFFICE

CERTIFICATE OF CORRECTION

PATENT NO. : 3,956,871
DATED : May 18, 1976
INVENTOR(S) : John A. Johnson

It is certified that error appears in the above-identified patent and that said Letters Patent are hereby corrected as shown below:

In the Abstract, line 12, "carbon" should be --carton--.

Column 1, line 15, "applies" should be --apply--.

Column 3, line 52, "YP" should be --VP--.

Column 4, line 6, "carbon" should be --carton--.

Column 7, line 54, "carbons" should be -- cartons --.

Column 8, line 16, "hip" should be --nip--.

Column 9, line 22, "section" should be --station--.

Column 12, line 44, "of" should be --or--.

Column 13, line 16, "data" should be --date--.

Column 15, line 27, "data" should be --date--.

Column 16, line 9, "out" should be --but--.

Column 17, line 18, "activate" should be --actuate--.

Column 18, line 19, "on" should be --to--.

Column 18, line 40, Claim 5, insert --carton-- between "sensing" and "upstream".

Column 18, line 60, Claim 8, "presence" should be --pressure--.

Column 23, line 31, Claim 42, "44" should be --41--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*